United States Patent [19]

Salas et al.

[11] Patent Number: 4,693,020

[45] Date of Patent: Sep. 15, 1987

[54] FLEXION CONTROL FOR SKI BOOT

[75] Inventors: Joseph Salas, Salt Lake City, Utah; Laurent Boix-Vives, Courchevel, France

[73] Assignee: Lange International S.A., Fribourg, Switzerland

[21] Appl. No.: 883,383

[22] Filed: Jul. 8, 1986

[30] Foreign Application Priority Data

Jan. 24, 1986 [CH] Switzerland ..... 285/86

[51] Int. Cl.[4] ..... A43B 5/04

[52] U.S. Cl. ..... 36/117; 36/121

[58] Field of Search ..... 36/117–121

[56] References Cited

U.S. PATENT DOCUMENTS

| | | | |
|---|---|---|---|
| 4,095,356 | 6/1978 | Robran et al. | 36/121 |
| 4,381,613 | 5/1983 | Lederer | 36/121 |
| 4,455,768 | 6/1984 | Salomon | 36/121 |
| 4,653,205 | 3/1987 | Koch | 36/117 |

FOREIGN PATENT DOCUMENTS

| | | | |
|---|---|---|---|
| 0155495 | 9/1985 | European Pat. Off. | 36/117 |
| 0172159 | 2/1986 | European Pat. Off. | 36/117 |
| 0182778 | 5/1986 | European Pat. Off. | 36/117 |
| 2539278 | 7/1984 | France | 36/117 |
| 2555418 | 5/1985 | France | 36/117 |
| 2564710 | 11/1985 | France | 36/117 |

*Primary Examiner*—James Kee Chi

*Attorney, Agent, or Firm*—Brumbaugh, Graves, Donohue & Raymond

[57] ABSTRACT

A flexion control for a ski boot for controlling the resistance to the forward movement of the upper shell of the ski boot relative to the lower shell in which a band of variable elasticity along its length is adjustable transversely across the upper surface of the lower shell between a bumper carried by the lower end of the upper shell and a rigid surface formed in a lower shell.

20 Claims, 11 Drawing Figures

FLEXION CONTROL FOR SKI BOOT

BACKGROUND OF THE INVENTION

This invention relates to flexion control for a ski boot and, more particularly, to means for controlling the flexion characteristics of the upper shell of the ski boot relative to the lower shell thereof.

In many conventional ski boots, the upper shell is pivotally connected to the lower shell, and provision is made for varying the flex characteristics of the upper shell relative to the lower shell. Such flexion control is desirable not only to accommodate the ski boot for skiers of different levels of skill, but also to permit the skier to vary the flexion characteristics for different skiing conditions while the ski boots are in use.

Toward this end, ski boots have been equipped with springs and other types of hardware to provide flexion control. Since snow and ice tend to build up on the hardware, these flexion control devices may not be dependable or effective and may even be dangerous.

The Robran et al. U.S. Pat. No. 4,095,356, issued June 20, 1978, discloses a ski boot in which opposed edges of the upper and lower shells define between them a pocketshaped cavity which accommodates a transversely extending resilient band to limit and control the flexion of the upper shell relative to the lower shell. The flexion characteristics can be adjusted by substituting a resilient band of different resiliency. The flexion control of the Robran et al. ski boot cannot be adjusted while the ski boot is worn by the skier.

The Salomon U.S. Pat. No. 4,455,768, issued June 26, 1984, discloses a ski boot in which the flexion can be adjusted by the skier while the ski boot is worn by the skier. The Salomon flexion control embodies a band which extends across at least part of the instep of the lower shell and a cursor which is slidably adjusted within the groove formed between the lower edge of the upper shell and the upper edge of the lower shell. The band is attached at opposite ends to either the lower shell or the lower cuff portion of the upper shell, and the cursor transmits the movement of the lower edge of the upper shell to the span of the band intermediate its anchored ends. In the Salomon flexion control, the resistance to the flexion of the upper shell relative to the lower shell is generally offset from the fore-and-aft centerline of the lower shell and, therefore, unsymmetrical with respect to the pivots of the upper shell.

SUMMARY OF THE INVENTION

The aim of the present invention is to provide a control device for controlling the resistance to forward movement of the upper shell of the ski boot relative to the lower shell with the upper applying force to the lower symmetrically, whereby the dynamic symmetry of the boot is maintained.

More particularly, the improved flexion control for a ski boot of the present invention is achieved by an adjustable band of variable elasticity in transversal compression interposed between the upper and lower shells of the ski boot. The elasticity of the operative section of the band determines the resistance that it offers the forward displacement of the lower end of the upper shell, and it varies progressively along the transverse length of the band from one transverse section to the next, so that by selecting an operative section of the band, the flexion between the upper and lower shells can be easily and quickly adjusted while the ski boot is used on a slope.

In the preferred embodiment, the operative section of the band is engaged by a bumper extending forwardly from the lower end of the upper shell and located generally along the fore-and-aft centerline of the lower shell so that the operative section of the band which resists the forward movement of the upper shell is located on the lower shell symmetrically with respect to the pivots of the upper shell.

DESCRIPTION OF THE DRAWINGS

For a more complete understanding of the present invention, reference can be made to the detailed description which follows and to the accompanying drawings, in which.

DESCRIPTION OF THE PREFERRED EMBODIMENTS

Figure 3:
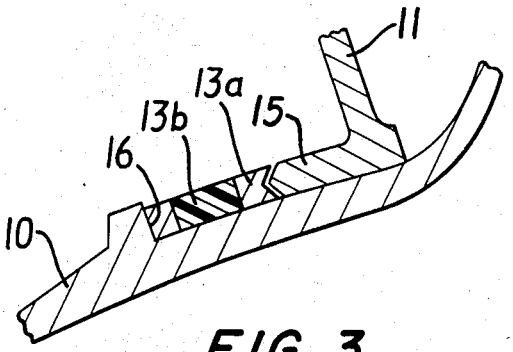
FIGS. 3 and 4 are cross-sectional views taken along the lines 3—3 and 4—4, respectively, of FIG. 2.
Figure 1:
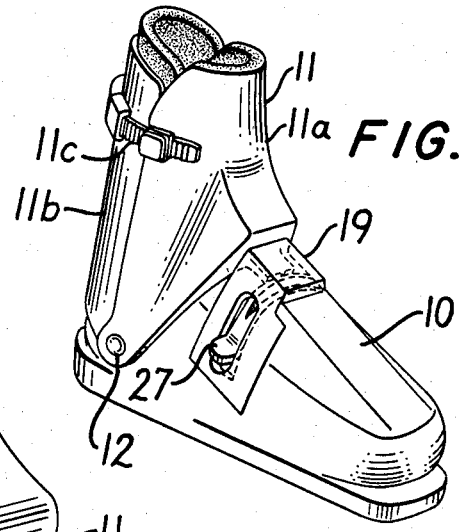
FIG. 1 is a perspective view of a ski boot embodying the present invention.

The ski boot of the present invention, as shown in FIG. 1, includes a lower shell 10 and an upper shell 11. The upper shell includes forward and rear portions 11*a* and 11*b*, respectively, pivotally connected to the lower shell 10 by journals 12 and held together by straps 11*c*. The upper and lower shell components are made of suitable, relatively rigid plastic material.

The forward flexion of the upper shell relative to the lower shell is controlled by a band 13 of variable elasticity in transversal compression extending transversely in a slot 14 across the upper surface of the lower shell. The band 13 is interposed between a bumper 15 which extends forwardly from the lower end of the upper shell and a rigid surface 16 formed in the lower shell and defining the front wall of the slot 14. A longitudinally extending slot 17 communicates with the transversely extending slot 14 to accommodate the bumper 15 for movement against the edge of the band opposite the edge which backs against the rigid surface 16. Preferably, the bumper 15 is located centrally and symmetrically with respect to the pivots of the upper shell and the slot 17 is located along the fore-and-aft centerline of the lower shell.

The band 13 works in transversal compression, i.e., in the direction of movement of the bumper 15. The band 13 is made of two materials 13*a* and 13*b* of different rigidity integrated one in another. The outer part 13*a* is made of relatively rigid material, for example polyurethane, and the inner part 13*b* is made of elastic material, for example rubber, which forms a narrow triangle integrated into the rigid material 13*a*. At the triangle base the band 13 presents a relatively great transversal elasticity. Such elasticity decreases progressively in the direction of the triangle apex and is practically zero in the region of only the rigid material 13*a*. When the band 13 is moved transversally to the right on the drawing, a more and more resistant portion is interposed between the bumper 15 and the rigid surface 16 so that the resistance to flexion of the boot upper relative to the lower increases progressively. As the band 13 is moved leftward, the resistance to flexion decreases. At the limit of its leftward movement, the bumper 15 passes the end of the band 13 and the resistance to flexion by the band is zero.

Figure 6:
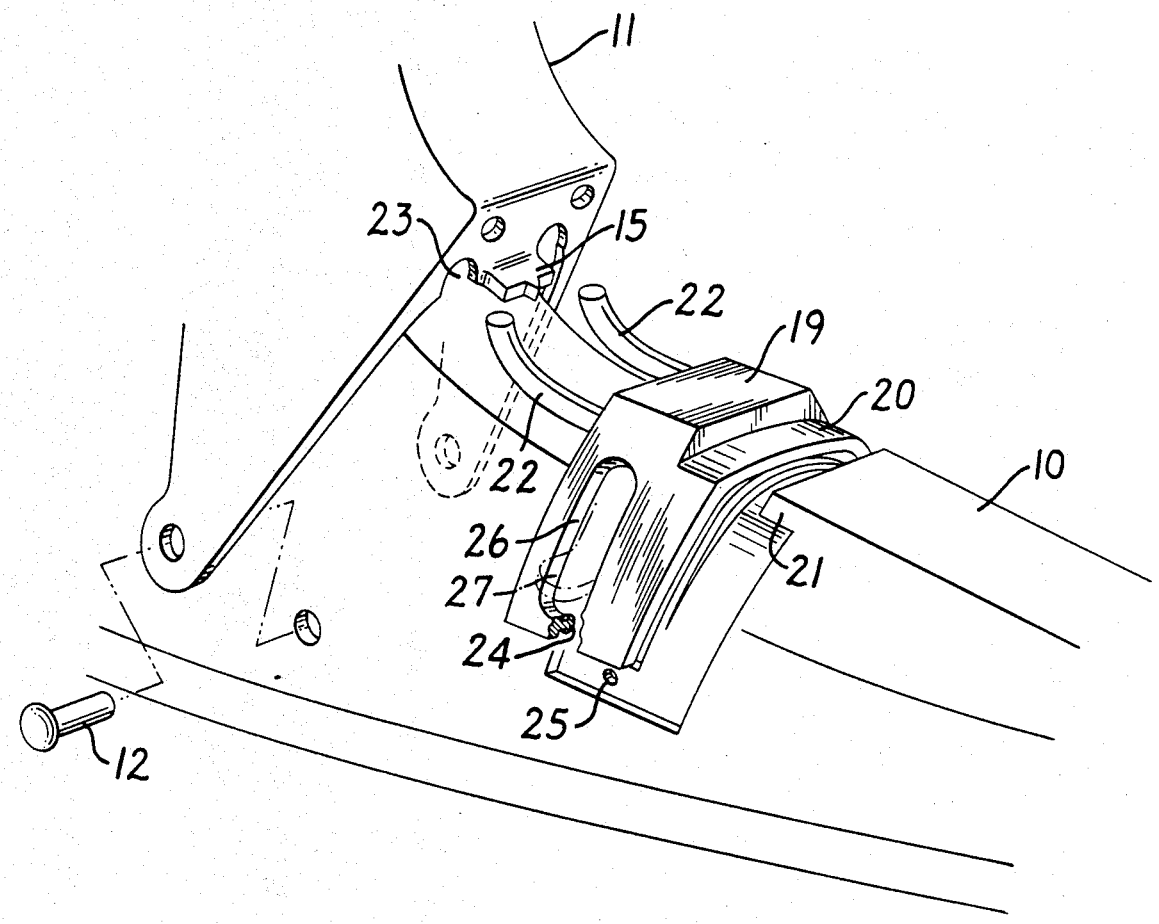
FIG. 6 is an exploded perspective view of the ski boot shown in FIG. 2.

The band 13 is retained within the slot 14 by a cover 19 mounted on the lower shell. As best shown in FIG. 6, the front end of the cover is recessed at 20 so that it can be received underneath an overlying retainer 21 of the lower shell. The opposite end of the cover has a pair of upwardly curved retainers 22 formed integrally with the rear of the cover, and these extend across the upper surface of the lower shell, passing through openings 23 in the front face of the upper shell on opposite sides of the bumper 15, thereby retaining the cover seated on the lower shell while permitting the upper shell to move relative to the lower shell. The lower depending ends of the cover 19 are formed with inwardly extending snap-lock connections 24 which engage and interlock in openings 25 in the lower shell.

In order to facilitate the adjustment of the band 13, the cover 19 is provided with an elongated opening 26, and an end 27 of the band protrudes outwardly through the elongated opening 26, so that the band can be easily gripped by the skier and displaced transversely within the slot 14.

Figure 2:
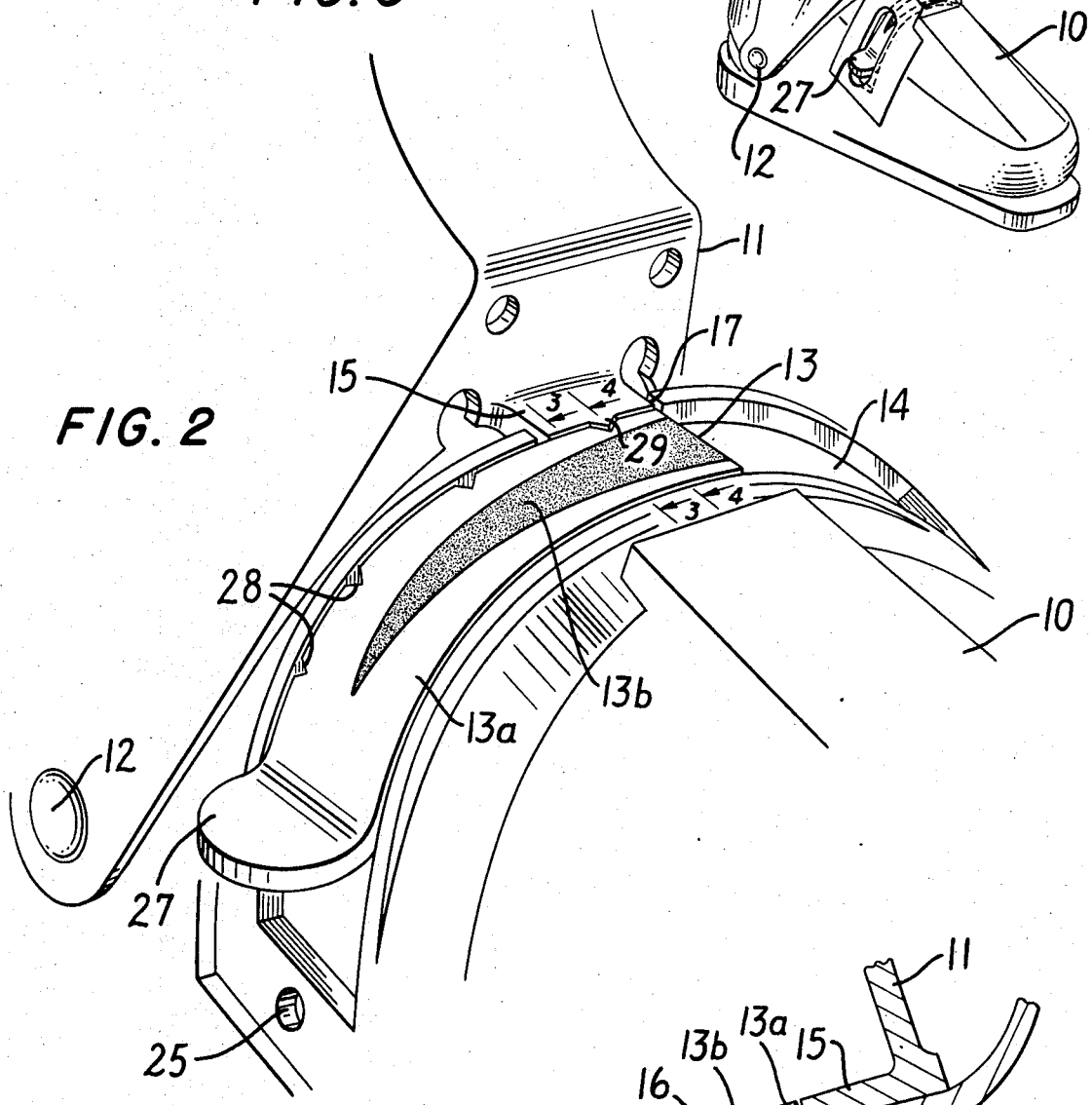
FIG. 2 is a fragmentary perspective view showing the flexion control of the present invention.
Figure 4:
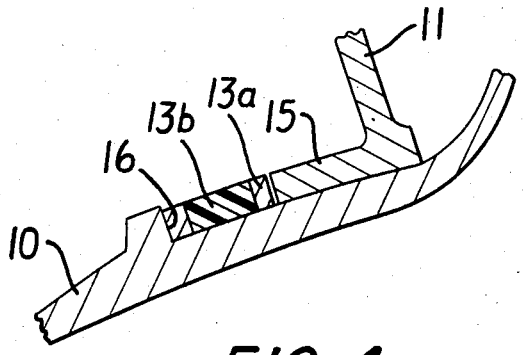

The band 13 can be retained in its adjusted position within the slot by interlocking means formed along an edge of the band. As shown in FIG. 2, a plurality of spaced-apart detents 28 is formed along one edge of the band and each is capable of engaging and interlocking with a tooth 29 in the middle of the bumper to retain the band in the desired position of adjustment. Alternatively, the interlocking tooth and detent means can be formed on the interfacing edges of the band and the rigid backing surface 16. The interfacing surfaces of the bumper 15 and the band on both sides of tooth 29, as shown in FIG. 4, are formed with interlocking complementary surfaces to help maintain them in proper register.

Figure 5A:
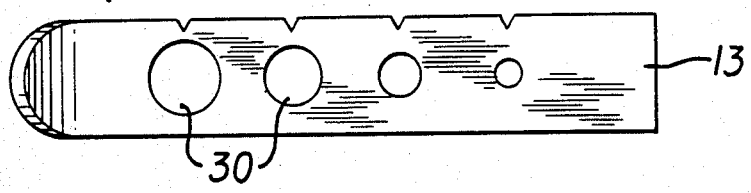
FIGS. 5*a*–5*e* show different embodiments of bands of variable resistance capable of use in the flexion control of the present invention.
Figure 5B:
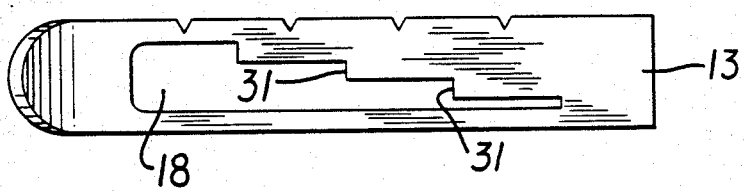
Figure 5C:
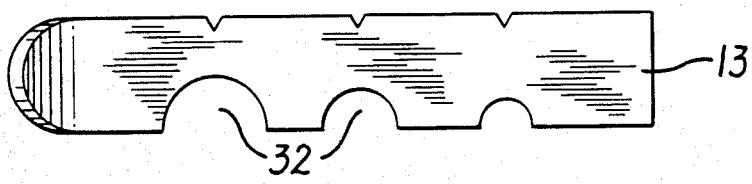
Figure 5D:
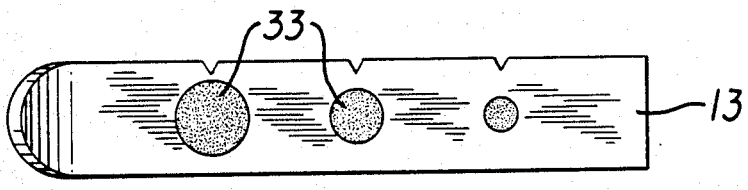
Figure 5E:
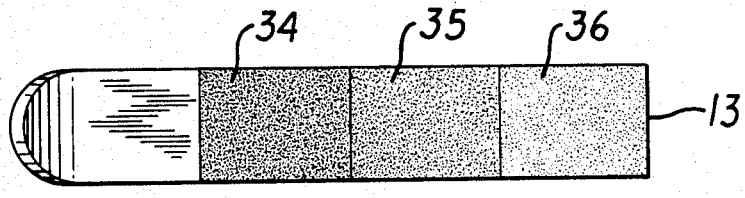

Alternative embodiments of the band of variable elasticity are shown in FIGS. 5*a*–5*e*. In the embodiment of FIG. 5*a*, the variable elasticity of the band in transversal compression is provided by apertures 30 of progressively varying size along the transverse length of the band. In the embodiment of the band illustrated in FIG. 5*b*, steps 31 are provided in the elongated aperture 18 to change its width. In the embodiment of FIG. 5*c*, the variable elasticity in the band is achieved by apertures 32 of progressively varying size formed along one transverse edge of the band. In the embodiment of FIG. 5*d*, the band is made of a more elastic and less rigid material containing a plurality of apertures of progressively varying size filled with a more rigid material 33. In the embodiment illustrated in FIG. 5*e*, the variable elasticity in the band is provided by making the band of sections 34, 35 and 36 of progressively varying hardness or modulus of elasticity along the transverse length of the band.

Figure 7:
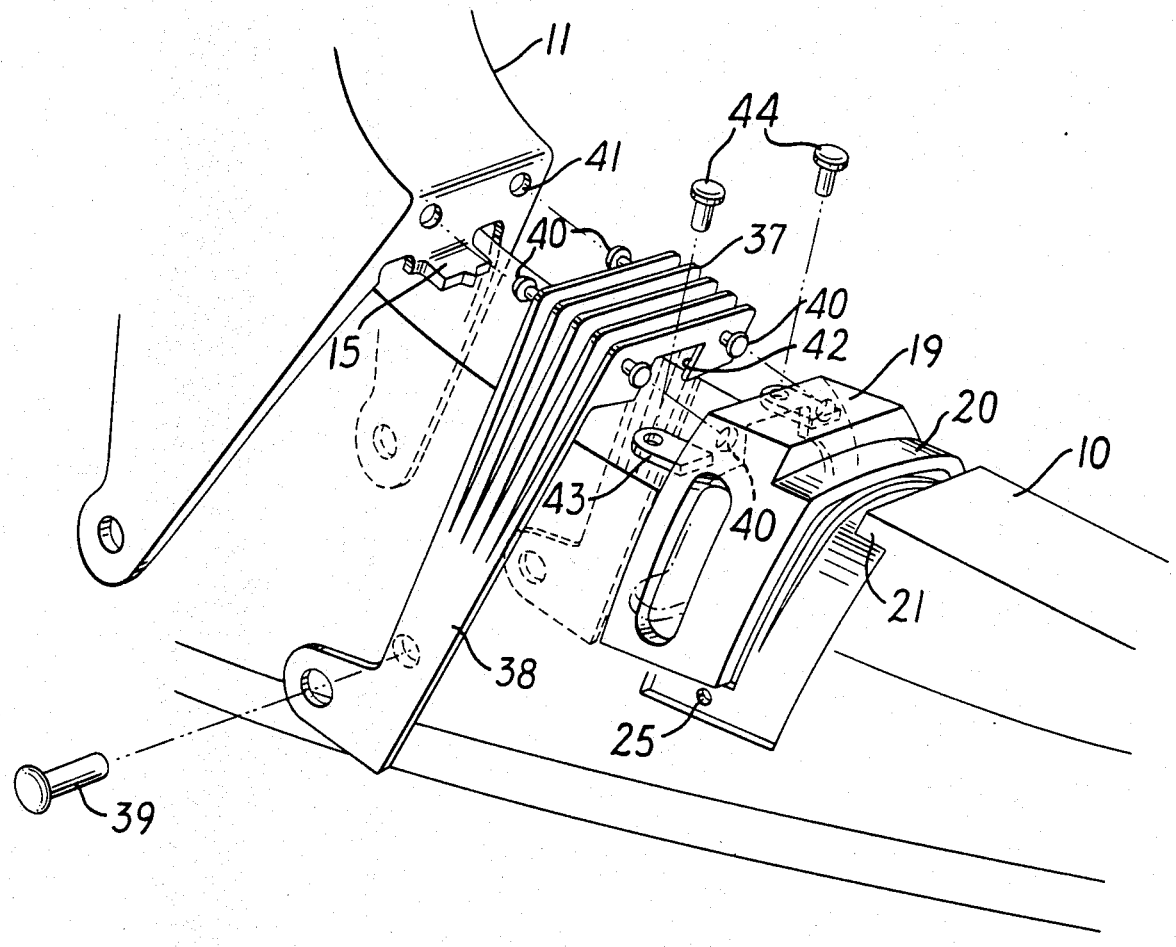
FIG. 7 is an exploded perspective view showing an alternative embodiment of the invention.

In the alternative embodiment of the ski boot shown in FIG. 7, a protective bellows 37 made of plastic material is accommodated intermediate the upper and lower above the flexion control of the present invention to protect the control device against snow and dirt. The bellows 37 is supported by depending legs 38 which are mounted to the lower shell by rivets 39. The fore-and-aft ends of the bellows carry snap-lock connections 40 which snap into holes 41 in the cover 19 and in the upper shell 11. The underside of the bellows 37 is cut away at 42 to accommodate the bumper 15. In this embodiment, the upwardly curved retainers 22 shown in FIG. 6 are replaced by a pair of spaced-apart flanges 43 which are anchored by rivets 44 to the upper surface of the lower shell 10.

With the flexion control of the present invention, the skier can readily adjust the flex characteristics of the ski boots at any time by sliding the band 13 transversely within the slot 14 from one position to another. This adjustment increases or decreases the resistance to the forward flex of the upper shell relative to the lower shell along a fore-and-aft line that extends generally along the median of the foot, so that the adjustment is made in the plane defined by the leg and foot of the skier and symmetrically of the pivots for the upper shell.

The invention has been shown and described in preferred forms and by way of example, and many other embodiments and variations are possible within the scope of the invention. For example, the band 13 may be formed with a plug on its bottom face cooperating with several recesses provided in the bottom of the slot 14 to maintain the band 13 in a selected position. Further, the bumper 15 may be slightly bent rearwardly by forces generated by relative movement of the upper and lower shells for neutralizing the hysteresis effect due to friction forces. The invention, therefore, is not intended to be limited to any particular form or embodiment, except insofar as such limitations are expressly set forth in the claims.

We claim:

1. A flexion control for a ski boot for controlling the resistance to the forward movement of the upper shell of the ski boot relative to the lower shell, comprising a band of variable elasticity in transversal compression extending transversely across the upper surface of the lower shell, a bumper carried by the lower end of the upper shell to engage one edge of the band, the relative positions of the band and bumper determining the degree of resistance offered by the band to the forward deflection of the upper shell relative to the lower shell, and a rigid surface formed in the lower shell engaging the opposite edge of the band to retain the band.

2. A flexion control as set forth in claim 1, in which the bumper extends forwardly from the center of the lower end of the upper shell so that it moves generally along the fore-and-aft centerline of the lower shell.

3. A flexion control as set forth in claim 1, including a slot extending transversely across the upper surface of the lower shell for accommodating the band for adjustable movement relative to the band bumper.

4. A flexion control as set forth in claim 3, including a longitudinal slot in the lower shell communicating with the transverse slot, said longitudinal slot accommodating the bumper for movement against the edge of the band.

5. A flexion control as set forth in claim 1, including a cover for said band to retain the band on the upper surface of the lower shell intermediate said bumper and said rigid surface.

6. A flexion control as set forth in claim 1, in which the band is adjustable transversely across the upper surface of the lower shell and including interlocking means formed on the band and on the lower shell for facilitating the location of the band relative to the bumper.

7. A flexion control as set forth in claim 1, in which the band is adjustable transversely across the upper surface of the lower shell and including interlocking means formed on the band and on the bumper for facilitating the location of the band relative to the bumper.

8. A flexion control as set forth in claim 5, including an elongated opening in the cover to provide access to the band for the adjustment of the band.

9. A flexion control as set forth in claim 5, including cover retaining means extending from the cover above the lower shell and within the upper shell.

10. A flexion control as set forth in claim 5, in which the cover is recessed under a retaining portion of the lower shell to retain the cover on the shell.

11. A flexion control as set forth in claim 1, including a bellows accommodated intermediate the upper and lower shells above the band.

12. A flexion control as set forth in claim 11 in which the bellows is interconnected between said upper and lower shells.

13. A flexion control system as set forth in claim 12, in which the bellows has depending supports and including means mounting the depending supports on the lower shell.

14. A flexion control as set forth in claim 5, in which a bellows is connected on one side to the upper shell and on the other side to the cover and is further provided with two legs, and means mounting the two legs on the lower shell.

15. A flexion control as set forth in claim 1, in which the variable elasticity in the band is provided by sections of progressively varying elasticity along the transverse length of the band.

16. A flexion control as set forth in claim 1, in which the band is made of two materials of different rig the width of the materials progressively varying along the length of the band to provide the band with variable elasticity.

17. A flexion control as set forth in claim 1, in which the variable elasticity in the band is provided by apertures of progressively varying size along the transverse length of the band.

18. A flexion control as set forth in claim 1, in which the variable elasticity in the band is provided by a slot of progressively increased width along the transverse length of the band.

19. A flexion control as set forth in claim 1, in which the interfacing edges of the band and bumper include complementary interlocking surfaces to keep them in proper registration.

20. A flexion control for a ski boot for controlling the resistance to the forward movement of the upper shell of the ski boot relative to the lower shell, comprising a band of variable elasticity in transversal compression extending transversely across the upper surface of the lower shell, and a pair of opposed band engaging surfaces engaging between them a section of the band which lies generally along the fore-and-aft centerline of the lower shell, one of said band engaging surfaces carried by the lower end of the upper shell to engage one edge of the band and the other formed on the lower shell engaging the opposite edge of the band to retain the band, whereby the transverse movement of the band relative to the band engaging surfaces changes the operative section of the band interposed between the band engaging surfaces.

* * * * *